US006872173B2

(12) United States Patent
Krull

(10) Patent No.: US 6,872,173 B2
(45) Date of Patent: Mar. 29, 2005

(54) ADJUSTABLE DUMBBELL METHODS AND APPARATUS

(76) Inventor: Mark A. Krull, P.O. Box 7198, Bend, OR (US) 97708

( * ) Notice: Subject to any disclaimer, the term of this patent is extended or adjusted under 35 U.S.C. 154(b) by 450 days.

(21) Appl. No.: 10/116,344

(22) Filed: Apr. 3, 2002

(65) Prior Publication Data

US 2002/0115539 A1 Aug. 22, 2002

Related U.S. Application Data

(60) Division of application No. 09/747,214, filed on Dec. 21, 2000, now Pat. No. 6,402,666, which is a continuation-in-part of application No. 09/290,144, filed on Apr. 13, 1999, now Pat. No. 6,322,481, which is a continuation-in-part of application No. 09/020,119, filed on Feb. 6, 1998, now Pat. No. 6,099,442.

(51) Int. Cl.[7] ..... A63B 21/075

(52) U.S. Cl. ..... 482/108; 482/98; 482/107

(58) Field of Search ..... 482/104, 106–108, 482/93, 94, 97, 98

(56) References Cited

U.S. PATENT DOCUMENTS 1,779,594 A * 10/1930 Collins ..... 482/107
3,825,253 A * 7/1974 Speyer ..... 482/106
4,529,198 A 7/1985 Hettick, Jr.
4,822,034 A 4/1989 Shields
5,284,463 A 2/1994 Shields
5,344,375 A 9/1994 Cooper
5,433,687 A * 7/1995 Hinzman et al. ..... 482/104
5,637,064 A 6/1997 Olson et al.
5,749,814 A * 5/1998 Chen ..... 482/93
5,769,762 A 6/1998 Towley, III
5,839,997 A 11/1998 Roth et al.
5,879,274 A 3/1999 Mattox
6,033,350 A 3/2000 Krull
6,039,678 A * 3/2000 Dawson ..... 482/107
6,083,144 A 7/2000 Towley, III
6,099,442 A 8/2000 Krull

OTHER PUBLICATIONS

Atlas Barbell/Dumbbell Rack #1008, Atlantic Fitness Products catalog, p. 40, 1985.*

Squat Rack #6015, Nebula Fitness Equipment catalog, 1995.*

* cited by examiner

*Primary Examiner*—Justine R. Yu
*Assistant Examiner*—Victor K. Hwang

(57) ABSTRACT

An exercise dumbbell includes a handle and weights that are selectively latched to opposite ends of the handle. A base is provided to support the handle and the weights when not in use.

20 Claims, 8 Drawing Sheets

200
268
218
214
267
213
212
220
217
210
211
218

200
268
220
267
216
213
219
210

267
268
217
260
200
210

200
260
245
240a
210

240a
200
217
260
240b
210

FIG. 17
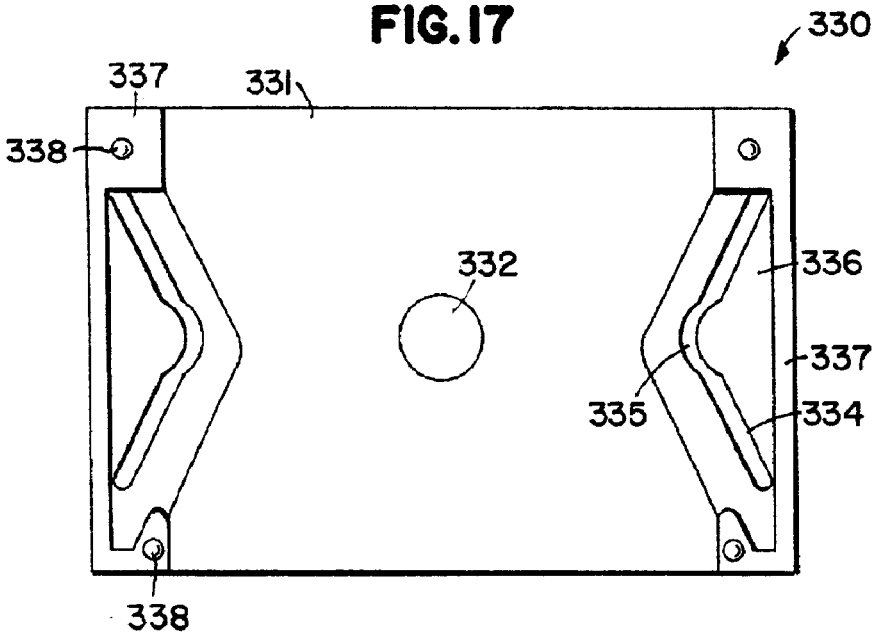
FIG. 18
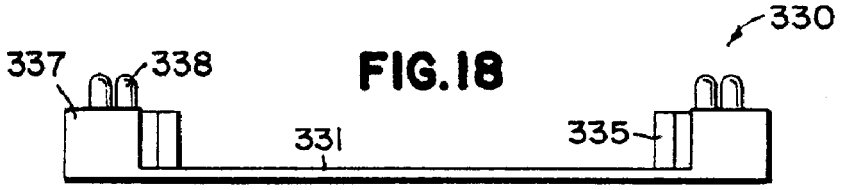
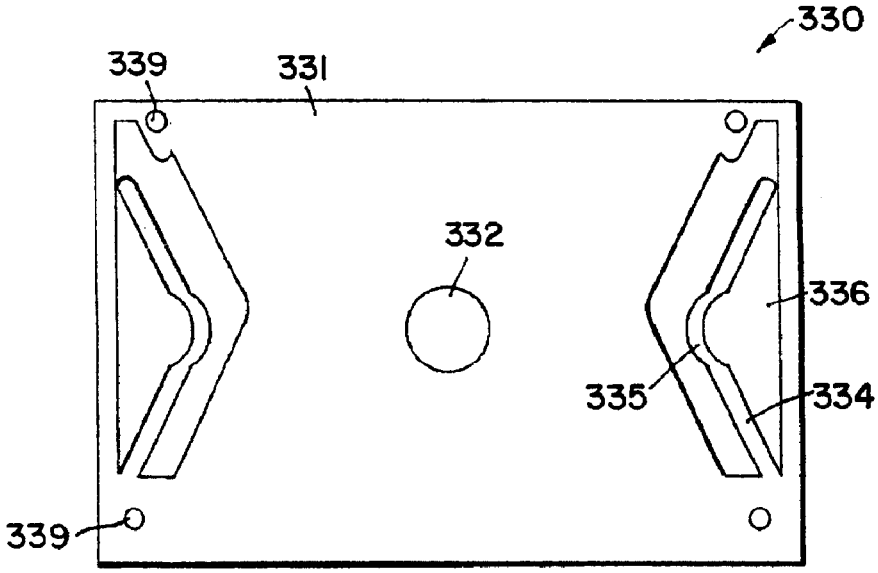
FIG. 19

ADJUSTABLE DUMBBELL METHODS AND APPARATUS

CROSS-REFERENCE TO RELATED APPLICATIONS

This is a divisional of U.S. patent application Ser. No. 09/747,214, filed on Dec. 21, 2000 (now U.S. Pat. No. 6,402,666, which in turn, is a continuation-in-part of U.S. patent application Ser. No. 09/290,144, filed on Apr. 13, 1999 (now U.S. Pat. No. 6,322,481), which in turn, is a continuation-in-part of U.S. patent application Ser. No. 09/020,119, filed on Feb. 6, 1998 (now U.S. Pat. No. 6,099,442).

FIELD OF THE INVENTION

The present invention relates to exercise equipment and more particularly, to adjustable weight dumbbells.

BACKGROUND OF THE INVENTION

Exercise dumbbells are well known in the art and prevalent in the exercise equipment industry. Generally speaking, each dumbbell includes a handle and a desired number of weights or plates which are secured to opposite sides of the handle. The dumbbell is lifted up subject to gravitational force acting on the mass of the handle and attached weights. An example of an adjustable weight dumbbell is disclosed in U.S. Pat. No. 5,637,064 to Olson et al. (shows a dumbbell assembly having a plurality of weights which are stored in nested relationship to one another and selectively connected to a handle).

SUMMARY OF THE INVENTION

The present invention provides methods and apparatus which facilitate exercise involving the movement of weights subject to gravitational force. Generally speaking, the present invention allows a person to adjust weight resistance by latching a desired number of weights relative to a movable member and/or providing a desired amount of weight on opposite sides of a base member. The present invention may be applied to exercise weight stacks and/or free weight assemblies such as dumbbells and barbells.

Among other things, the present invention may be described in terms of a method of facilitating weight adjustment on an exercise dumbbell. A handle assembly is provided with a first plate, a second plate, a handle interconnected between the first plate and the second plate, a first bar projecting outward from the first plate in a first direction away from the handle, and a second bar projecting outward from the second plate in a second, opposite direction away from the handle. A first weight is configured to be secured in place between the first plate and a distal end of the first bar with the first bar occupying a downwardly opening slot in the first weight. A second weight is configured to be secured in place between the second plate and a distal end of the second bar with the second bar occupying a downwardly opening slot in the second weight. A base is provided with an upwardly facing support surface configured to support the handle assembly, and a discrete portion configured to support each said weight independent of the handle assembly. At least one said weight is selectively lifted and moved between the handle assembly and the discrete portion of the base. Many of the features and advantages of the present invention will become apparent to those skilled in the art from the more detailed description that follows.

BRIEF DESCRIPTION OF THE FIGURES OF THE DRAWING

With reference to the Figures of the Drawing, wherein like numerals represent like parts and assemblies throughout the several views.

FIG. 17 is an end view of one of the weight supports on the dumbbell of FIG. 14;

FIG. 18 is a bottom view of the weight support of FIG. 17;

FIG. 19 is an opposite end view of the weight support of FIG. 17;

DETAILED DESCRIPTION OF A PREFERRED EMBODIMENT

Figure 1:
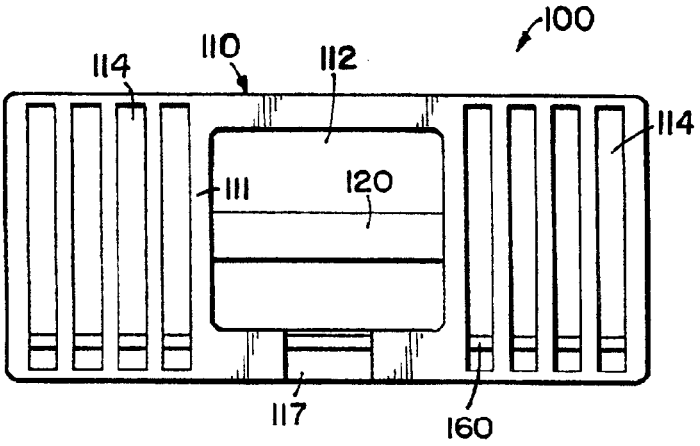
FIG. 1 is a top view of a first exercise dumbbell constructed according to the principles of the present invention.
Figure 2:
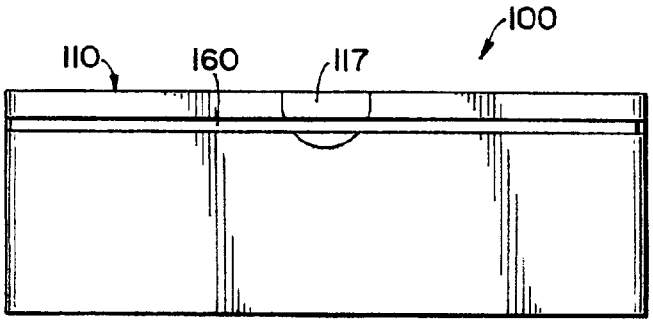
FIG. 2 is a front view of the dumbbell of FIG. 1.

For purposes of discussion, the present invention is described with reference to exercise dumbbells. However, those skilled in the art will recognize that one or more of the features which are disclosed herein with reference to dumbbells may be applied to barbells and/or weight stack machines, as well. Some examples of reciprocity between these two types of applications are disclosed in U.S. Pat. No. 6,033,350, which is incorporated herein by reference.

A first dumbbell constructed according to the principles of the present invention is designated as 100 and described with reference to FIGS. 1–8. The dumbbell 100 includes a parallelepiped block 110, which is preferably one or two pieces of injection molded plastic. A central opening 112, bounded by opposing end walls 111, is provided in the block 110 to receive and accommodate a person's hand. A cylindrical handle 120 is disposed within the opening 112 and extends perpendicularly between the end walls 111. The handle 120 has an outer diameter of about one inch and is sized and configured to be grasped.

Eight slots 114 are provided in the block 110 to receive and accommodate weights 140*a* and 140*b*. Each slot 114 is sized and configured to receive up to five one-pound weights 140*a* or one five-pound weight 140*b*. In other words, up to forty pounds of weights 140*a* and 140*b* may be inserted into the block 110.

Figure 6:
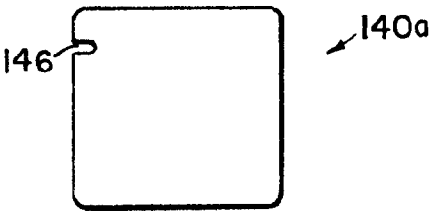
FIG. 6 is an end view of one of the weights of FIG. 4.

FIG. 6 shows an end view of one of the weights 140*a*. The weight 140*a* is a twelve gauge steel plate approximately six inches wide and six inches high (the weights 140*b* present the same end view and are five times as thick). A notch 146 is provided in the weight 140*a* to accommodate a latch or selector rod 160, as further explained below. The sidewalls of the notch 146 may be made outwardly divergent in order to facilitate insertion of the latch 160 into the notch 146.

Figure 3:
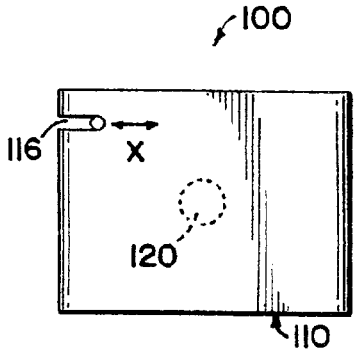
FIG. 3 is an end view of the dumbbell of FIG. 1.
Figure 4:
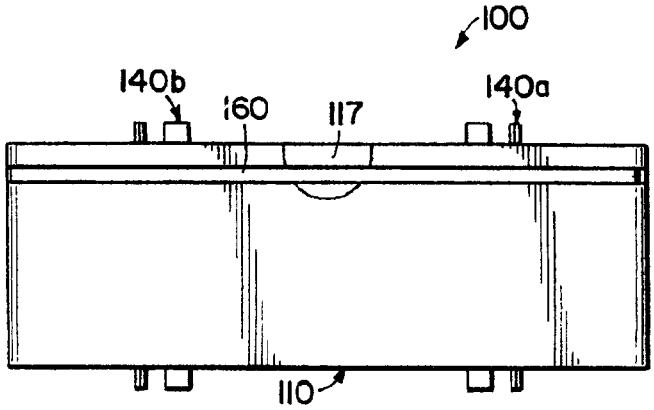
FIG. 4 is a front view of the dumbbell of FIG. 1 with a plurality of weights connected thereto.

FIG. 3 shows an end view of the block 110. A longitudinal notch 116 is provided in the block 110 to align with the notch 146 in the weight 140*a* and likewise accommodate the latch 160. This notch may be provided with outwardly divergent sidewalls, as well. A transverse notch 117 is provided in the block 110 to facilitate operation of the latch 160 as further explained below.

Figure 5:
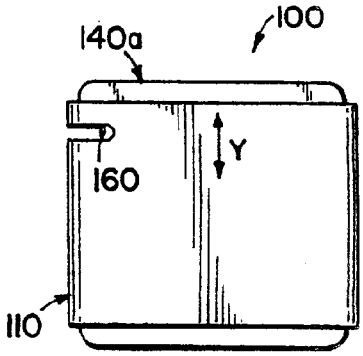
FIG. 5 is an end view of the dumbbell and weights of FIG. 4.
Figure 7:
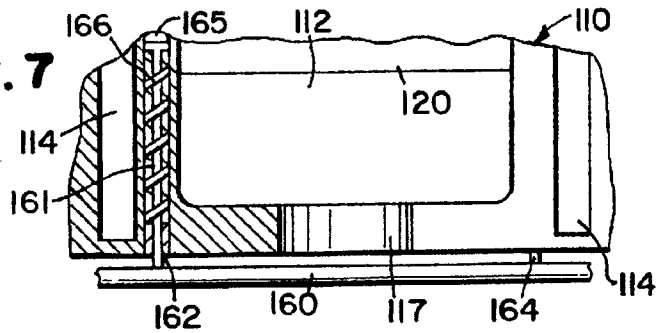
FIG. 7 is an enlarged and partially sectioned top view of a portion of the dumbbell of FIG. 1 with a latch portion occupying a discrete position relative to the remainder of the dumbbell.

As indicated by the arrows in FIG. 3, the latch 160 is movable in the direction X relative to the block 110. As shown in FIG. 7, the latch is movable (in the direction X) to a position outside the confines or planform of the block 110. When the latch 160 occupies the "open" position shown in FIG. 7, the weight 140*a* is freely movable in the direction Y (shown in FIG. 5) relative to the block 110. FIG. 5 shows the relative positions of the weights 140*a* and 140*b* and the block 110 when the notches 116 and 146 are aligned to receive the latch 160. When the weights 140*a* and 140*b* are latched in place, the longitudinal axis of the handle 120 is generally aligned with the inertia centers of the weights 140*a* and 140*b*.

When the latch 160 occupies the "closed" position shown in FIG. 5, the weight 140*a* is latched against movement relative to the block 110 (in the direction Y or otherwise). In particular, the relatively longer walls of the slot 114 prevent the weight 140*a* from moving axially relative to the handle 120; and the relatively shorter walls of the slot 114 prevent the weight 140*a* from moving in the radial direction X; and the latch 160 (along with the opposite, relatively shorter wall of the slot 114) prevents the weight 140*a* from moving in the radial direction Y.

FIG. 7 shows how the latch 160 is movably connected to the block 110. A cylindrical opening or bore 161 is provided in each of the end walls 111 of the block 110 to receive a respective shaft 164. Each shaft 164 has a first end connected to the latch 160 and a second, opposite end having a relatively large diameter head 165. A helical spring 166 is mounted on each shaft 164 and compressed between the head 165 and a plug 162 which inserts into the proximate end of the opening 161 to secure the spring 166 and the head 165 therein. The spring 166 biases the latch 160 toward the notches 116 and 146 and the closed position shown in FIG. 5. The spring 166 acts in the direction X, perpendicular to the direction Y, and thus, is not subject to gravitational force acting on the weight 140*a*.

The notch 117 enables a person to "reach behind" the latch 160 and pull it toward the open position shown in FIG. 7. The relative sizes of the weights 140*a* and 140*b* and the block 110 are such that the block 110 may be pushed downward relative to the weights 140*a* and 140*b* to temporarily secure the latch 160 in the open position (bearing against the outside edges of the weights 140*a* and 140*b*). Subsequent upward movement of the block 110 relative to the weights 140*a* and 140*b* will cause the latch 160 to snap into the notches 116 and 146.

Figure 8:
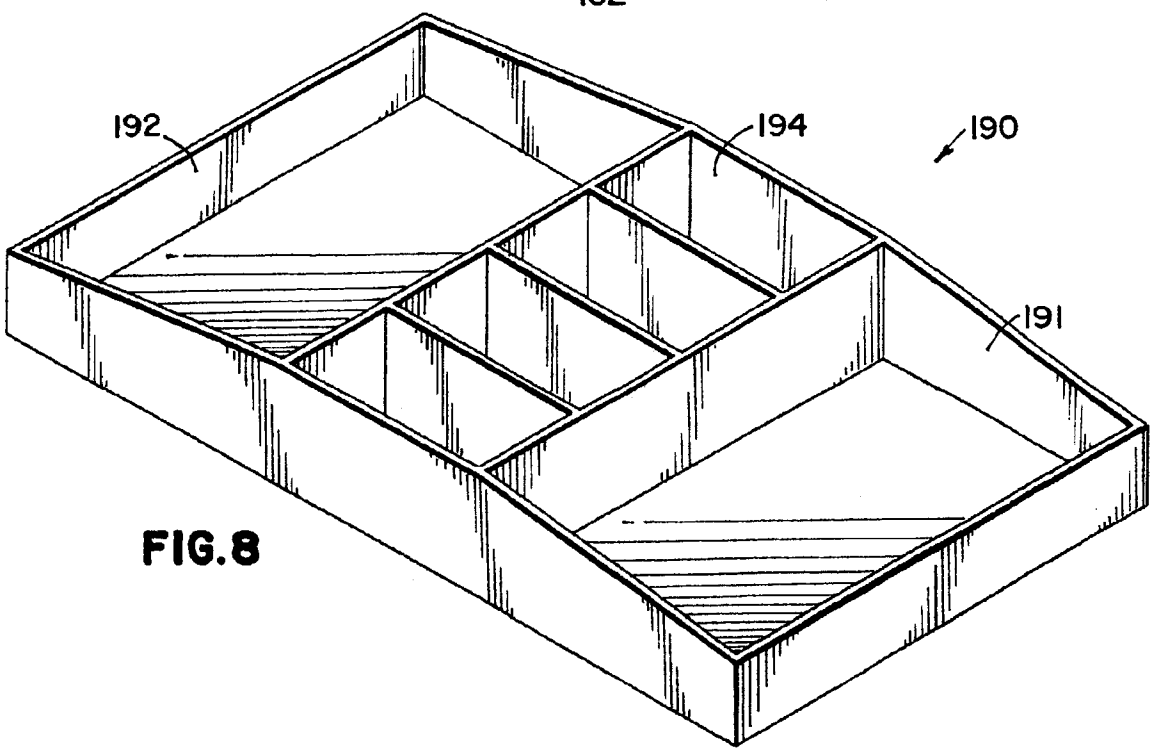
FIG. 8 is a perspective view of a base sized and configured to support two of the dumbbells of FIG. 1 and the weights of FIG. 4.

FIG. 8 shows a base or housing 190 which is sized and configured to receive two of the dumbbells 100 and up to eighty pounds of weights 140*a* and 140*b*. A first compartment 191 is provided for one dumbbell 100, and a second compartment 192 is provided for another dumbbell 100. Each of four compartments 194 is sized and configured to receive and accommodate twenty pounds of weights 140*a* and 140*b*. In a preferred embodiment, twenty one-pound weights 140*a* and twelve five-pound weights 140*b* are provided together with two blocks 110 and one base 190. Assuming that each block 110 weighs three pounds, this arrangement provides two dumbbells 100 which may be adjusted between three and forty-three pounds in one pound increments.

Among other things, those skilled in the art will recognize that the dumbbell 100 and/or the base 190 provide convenient and reliable means for holding the weights in place prior to selection; changing the amount of weight engaged for exercise motion; supporting the weights during exercise motion; and/or returning the weights to their proper location at the conclusion of exercise motion.

Those skilled in the art will further recognize a variety of modifications to the foregoing embodiment which fall within the scope of the present invention. For purposes of illustration, some of the many possible variations are embodied on a dumbbell designated as 200 and described with reference to FIGS. 9–13. This second dumbbell 200 similarly includes a block-shaped member 210, which is preferably one or two pieces of injection molded plastic. A central opening 212 is provided in the block 210 to receive and accommodate a person's hand. The opening 212 is bounded by opposing end walls 211. A cylindrical handle 220 is disposed within the opening 212 and extends perpendicularly between the end walls 211.

Eight upwardly opening slots or compartments 214 are provided in the block 210 to receive and accommodate weights 240*a* and 240*b*. The compartments 214 are bounded by a bottom wall 219, and the handle 220 is positioned to align more with the centers of inertia of the weights 240*a* and 240*b* within the compartments 214 than with the geometric center of the end walls 211 on the block 210. The compartments are bounded by flanges 213 rather than continuous intermediate walls. One compartment 214 on each side of the block 210 is sized and configured to receive one ten-pound weight 240*b,* and the other three compartments 214 on each side of the block 210 are sized and configured to receive up to five one-pound weights 240*a* or one five-pound weight. In other words, up to fifty pounds of weights 240*a* and 240*b* may be inserted into the block 210.

The weight 240*a* is a twelve gauge steel plate approximately six inches wide and six inches high (the weights 240*b* are similar in shape but ten times as thick). Like on the first dumbbell weights 140*a* and 140*b,* a notch is provided in each weight 240*a* and 240*b* to accommodate a latch or selector rod 260, as further explained below. In addition, a hemispherical opening 245 is provided in each weight 240*a* and 240*b* to facilitate handling of the weights 240*a* and 240*b*.

Figures 9, 10, 11, 12, 13:
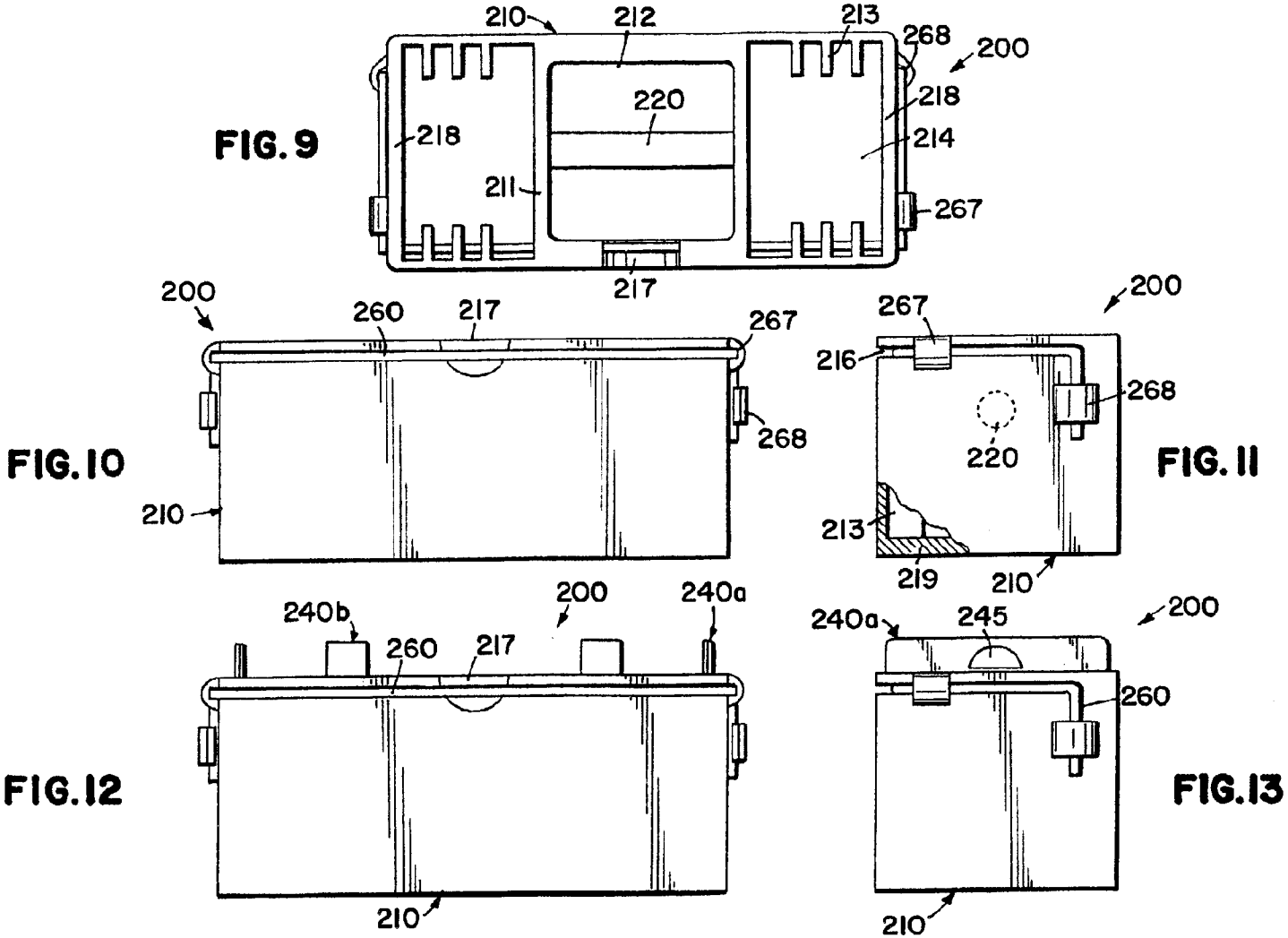
FIG. 9 is a top view of a second exercise dumbbell constructed according to the principles of the present invention.
FIG. 10 is a front view of the dumbbell of FIG. 9.
FIG. 11 is a partially sectioned end view of the dumbbell of FIG. 9.
FIG. 12 is a front view of the dumbbell of FIG. 9 with a plurality of weights connected thereto.
FIG. 13 is an end view of the dumbbell and weights of FIG. 12.
Figure 14:
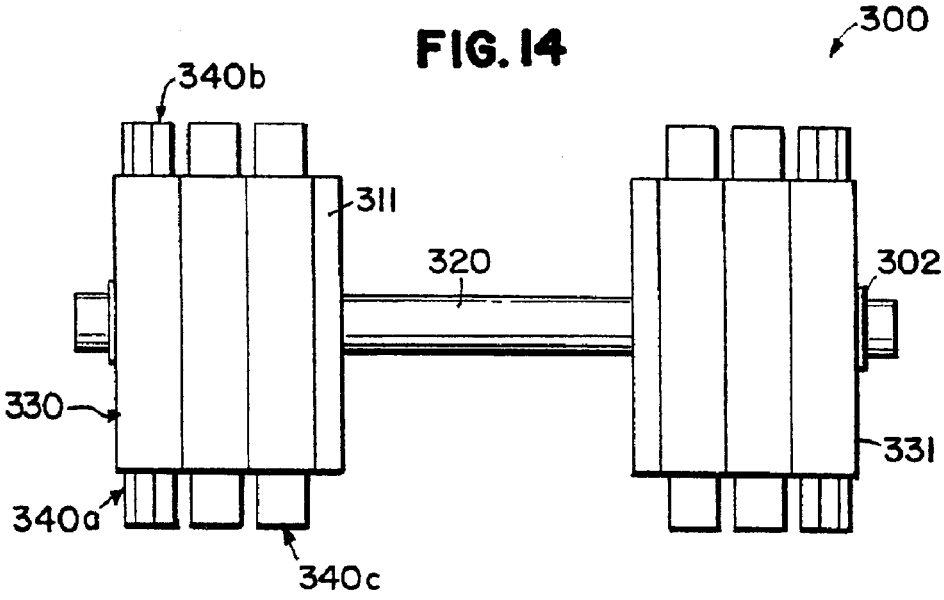
FIG. 14 is a front view of a third exercise dumbbell constructed according to the principles of the present invention.
Figure 15:
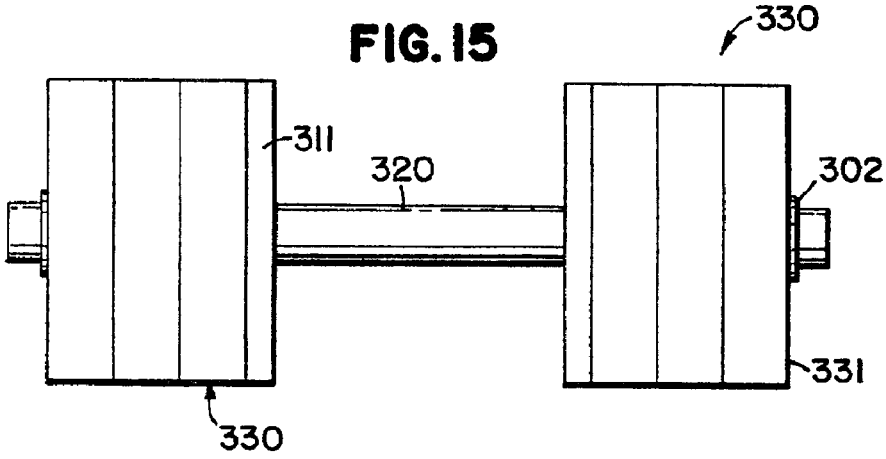
FIG. 15 is a front view of the dumbbell of FIG. 14 with the weights removed.

FIG. 11 shows an end view of the block 210. A notch 216 is provided in the block 210 to align with the notches in the weights 240*a* and 240*b* and likewise accommodate the latch 260. A discrete notch 217 is provided in the block 210 to facilitate manipulation of the latch 260, as further explained below.

As in the case of the first embodiment 100, the latch 260 is movable in a first, horizontal direction relative to the block 210 (with reference to the upright orientations shown in FIGS. 10–13). The latch 260 is movable between an open position, outside the planform of the block 210, and a closed position, shown in FIGS. 11 and 13. When the latch 260 occupies the open position, the weights 240*a* and 240*b* are movable in a second, vertical direction relative to the block 210. FIG. 13 shows the relative positions of the weights 240*a* and 240*b* and the block 210 when the notches are aligned to receive the latch 260. When the latch 260 occupies the closed position, the weights 240*a* and 240*b* are latched against movement relative to the block 110 (in any direction).

The latch 260 includes a middle portion which selectively occupies the notch 216, opposite outside portions which extend perpendicularly away from the middle portion and overlie opposite outside walls 218 of the block 210, and opposite distal portions which extend perpendicularly away from respective outside portions and toward the bottom wall 219. The outside portions are slidably mounted to respective outside walls 218 by means of sleeve members 267, and the distal portions snap into and out of engagement with resilient clip members 268. The clip members 268 releasably retain the latch 260 in the closed position inside the notch 116. The arrangement is such that the clip members 268 are not subject to gravitational force acting on the weights 240*a* and 240*b*. Like on the first dumbbell 100, the notch 217 enables a person to "reach behind" the latch 260 and pull it toward the open position.

A base or housing similar to that shown in FIG. 8 may be provided for two of the dumbbells 200 and up to one hundred pounds of weights. In a preferred embodiment, the base is sized and configured to receive and accommodate twenty one-pound weights 240*a,* eight five-pound weights (not shown), and four ten-pound weights 240*b*. Assuming that each block 210 weighs three pounds, this arrangement provides two dumbbells 200 which may be adjusted between three and fifty-three pounds in one pound increments.

Among other things, those skilled in the art will recognize that the second embodiment provides convenient and reliable means for enclosing the weights during exercise motion, as well as holding the weights in place prior to selection; changing the amount of weight engaged for exercise motion; supporting the weights during exercise motion; and/or returning the weights to their proper location at the conclusion of exercise motion.

Figure 16:
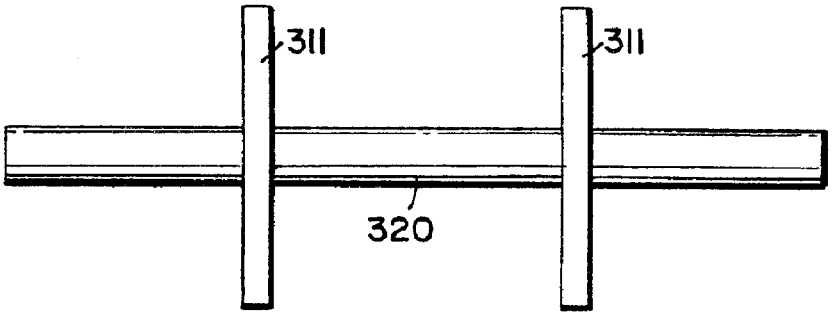
FIG. 16 is a front view of the dumbbell of FIG. 14 with the weights and the weight supports removed.

Additional variations of the present invention are embodied on a dumbbell designated as 300 and described with reference to FIGS. 14–21. As shown in FIG. 16, this third dumbbell 300 has a cylindrical bar 320 which is approximately sixteen inches long and one inch in diameter. Rigid plates 311 are secured to the bar 320 at locations about six inches apart from one another, thereby defining an intermediate handle portion and opposite distal portions.

Three weight supports or housings 330 are mounted on each of the distal portions of the bar 320, adjacent a respective plate 311. As shown in FIGS. 17–19, each housing 330 has a rectangular end wall 331 and opposite side walls or shoulders 337. A hole 332 is formed through the end wall 331 to receive the bar 320, and each housing 330 is mounted on the bar 320 in such a manner that the end wall 331 is relatively distant from the plates 311. The plates 311 have the same rectangular shape as the end walls 331.

The innermost housing 330 on each side of the bar 320 cooperates with a respective plate 311 to define a weight compartment or slot. The intermediate housing 330 on each side of the bar 320 cooperates with the end wall 331 of a respective innermost housing 330 to likewise define a weight compartment or slot. Similarly, the outermost housing 330 on each side of the bar 320 cooperates with the end wall 331 of a respective intermediate housing 330 to likewise define a weight compartment or slot. Posts 338 on the housings 330 cooperate with holes 339 in adjacent housings 330 and the plates 311 to maintain alignment and facilitate interconnection of the parts. A fastener 302 is fixedly mounted on each end of the bar 320 to prevent axial movement of the housings 330 relative to the bar 320.

Leaf springs 334 are provided on opposite sides of the housing 330. The leaf springs 334 may be described as inwardly convex and/or as having inwardly projecting portions 335 which are generally arcuate in shape. As further explained below, the leaf springs 334 perform both the latching and biasing functions which required discrete components on the previous embodiments. Openings 336 are provided in the end wall 331 to facilitate injection molding process which makes the housings 330.

Each compartment on the dumbbell 300 is sized and configured to receive up to five pounds of weight. For example, each compartment may support five one-pound weights 340*a,* or two two-pound weights 340*b* and one one-pound weight 340*a,* or one five-pound weight 340*c*. In other words, up to thirty pounds of weights 340*a*–340*c* may be inserted into the compartments on the dumbbell 300. A base similar to that shown in FIG. 8 may be provided for two of the dumbbells 300 and up to sixty pounds of weights. In a preferred embodiment, the base is sized and configured to receive and accommodate four one-pound weights 340*a,* eight two-pound weights 340*b,* and eight five-pound weights 340*c*. Assuming that each "empty" dumbbell 300 weighs three pounds, this arrangement provides two dumbbells 300 which may be adjusted between three and thirty-three pounds in one pound increments.

Figure 20:
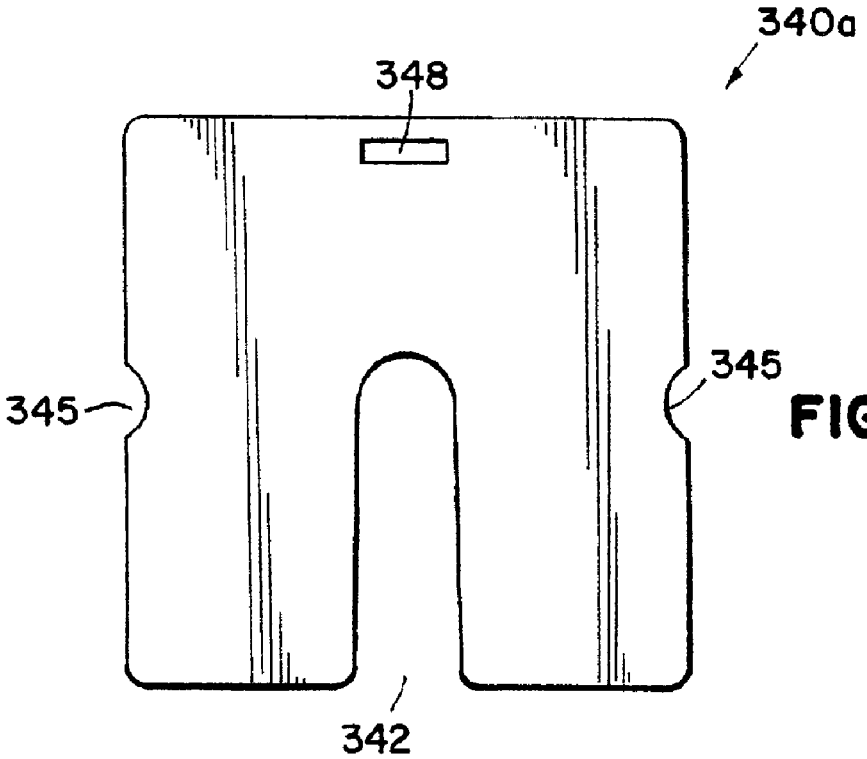
FIG. 20 is an end view of one of the weights on the dumbbell of FIG. 14.

The weight 340*a* is a twelve gauge steel plate approximately six inches wide and seven inches high (the weights 340*b* are similar in shape but twice as thick, and the weights 340*c* are similar in shape but five times as thick). As shown in FIG. 20, a relatively deep, central notch 342 is provided in each weight 340*a*–340*c* to accommodate or provide clearance for the bar 320. Relatively shallow, arcuate notches 345 are provided in opposite sides of each weight 340*a*–340*c* to interact with the arcuate portions 335 of the leaf springs 334. In particular, as the weight 340*a* is inserted into a compartment, the peripheral edges of the weight 340*a* encounter the opposing leaf springs 334 and force the latter away from one another. When the arcuate portions 335 of the leaf springs 334 encounter the notches 345, the former snap toward one another and into the latter to bias the weight 340*a* against further movement relative to the housing 330.

The weights 340*a*–340*c* may be removed from the compartments by pushing the assembly downward against a floor surface. Under such circumstances, the weights 340*a*–340*c* press against the floor and thus, are subjected to an upward force equal in magnitude to the downward force. When the force is sufficient to overcome the biasing effect of the leaf springs 334, the arcuate portions 335 deflect away from one another and out of the notches 345. Once the arcuate portions 335 are bearing against the linear edges of the weights 340*a*–340*c*, the leaf springs 334 offer little resistance to removal of the weights 340*a*–340*c*.

Figure 21:
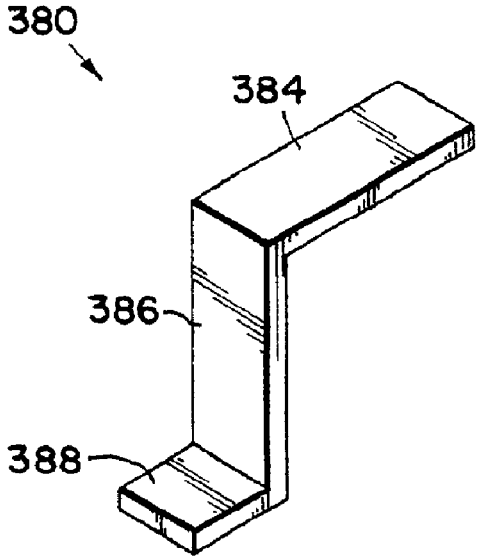
FIG. 21 is a perspective view of an optional tool suitable for use together with the dumbbell of FIG. 14.

An alternative method of removing the weights 340*a*–340*c* from the compartments may be described with reference to an optional opening 348 shown in the weight 340*a* in FIG. 20 and an optional tool 380 shown in FIG. 21. The tool 380 has a first distal portion 384 sized and configured for grasping, an intermediate portion or offset 386, and a second distal portion 388 sized and configured to insert into the opening 348 in the weight 340*a*. The tool 380 essentially allows a user to "grab" any of the weights 340*a*–340*c* and exert a sufficiently large pulling force to extract same from a weight housing 330.

Among other things, those skilled in the art will recognize that the dumbbell 300 provides convenient and reliable means for holding the weights in place prior to selection; changing the amount of weight engaged for exercise motion; supporting the weights during exercise motion; and/or returning the weights to their proper location at the conclusion of exercise motion.

Still more variations of the present invention are embodied on a dumbbell designated as 400 and described with reference to FIGS. 22–29. This fourth dumbbell 400 generally includes a handle assembly 410, a plurality of weights 440*a*–440*h* which are selectively connected to the handle assembly 410, and a base 490 which supports any of the weights 440*a*–440*h* that are not connected to the handle assembly 410.

The handle assembly 410 includes first and second plates 411 which are oval in shape. The plates 411 are rigidly secured to a cylindrical bar 420 at discrete locations spaced about six inches apart from one another. The bar 420 has an outside diameter of approximately one inch and is approximately sixteen inches long. The plates 411 cooperate with the bar 420 to define an intermediate bar portion which is sized and configured for grasping, as well as opposite distal ends of the bar 420. A rod 418 is rigidly secured between the plates 411 for reasons explained below.

A latch 430 is movably connected to the plates 411. The latch 430 may be described as equal in length to the bar 420 and extending parallel thereto. Optional end plates, similar in size and shape to the plates 411, for example, may be secured to the opposite, distal ends of the bar 420 to eliminate any perceived or potential hazard posed by protruding ends. The latch 430 moves within generally L-shaped slots 413 in the plates 411 (primarily in the radial direction designated as Y in FIG. 24). The latch 430 is movable between a "closed" position, shown in FIGS. 22–23, and an "open" position, shown in FIGS. 24–25, as more fully explained below.

The handle assembly 410 further includes a means for locking the latch 430 in either position relative to the plates 411. In particular, a relatively long tube 432 is movably mounted on the latch 430 between the plates 411. One end of the tube 432 has a relatively larger inside diameter which is bounded axially by a shoulder or rim 434. A relatively smaller tubular member 436 is mounted on the latch 430 proximate the larger diameter end of the long tube 432. A helical spring 438 is disposed within the larger diameter end of the tube 432 and compressed between the member 436 and the rim 434. The spring 438 biases the tube 432 away from the member 436.

Figures 22, 23, 24, 25:
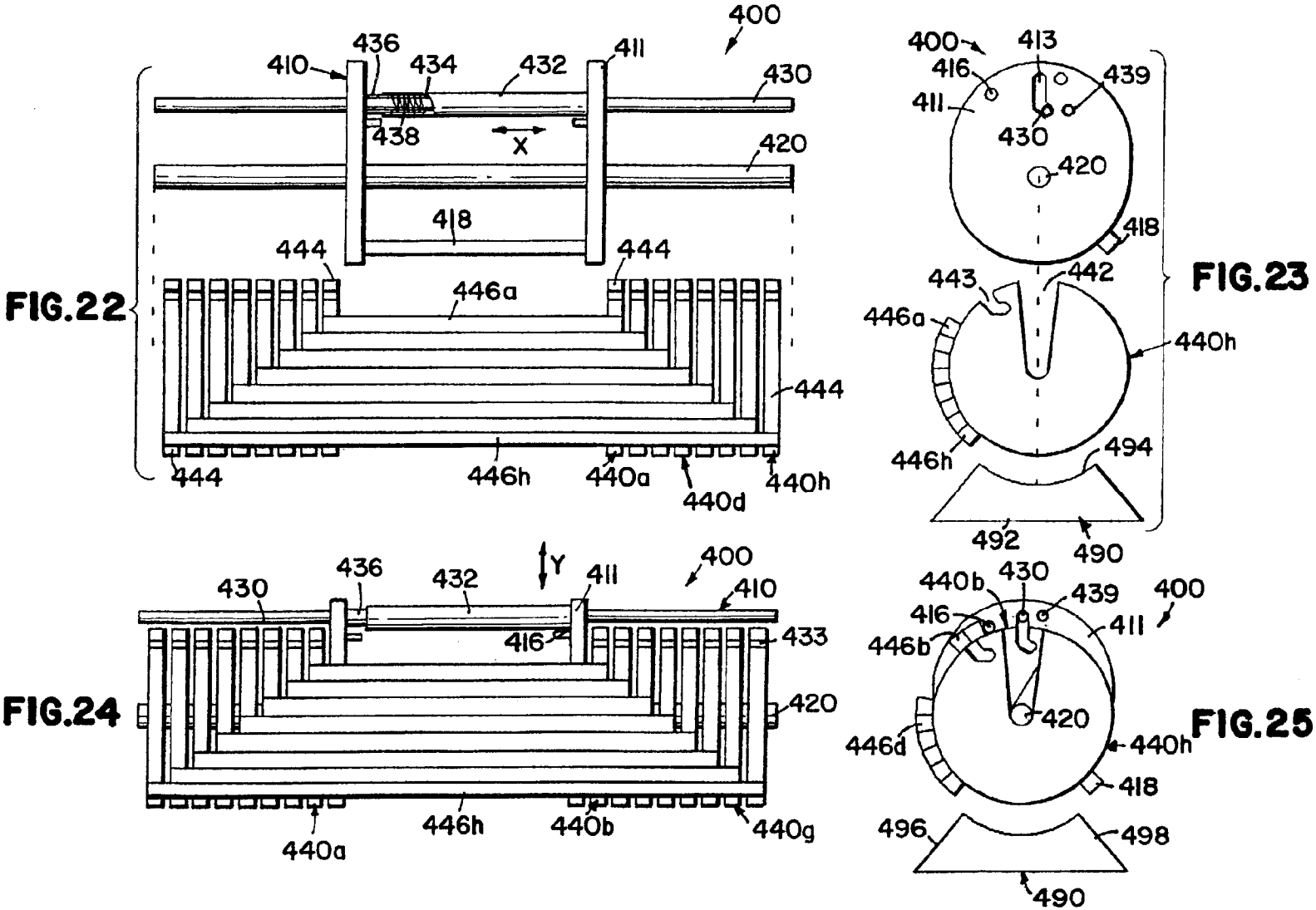
FIG. 22 is a front view of a fourth exercise dumbbell constructed according to the principles of the present invention, shown in an operative configuration with no discretionary weights connected to the handle assembly.
FIG. 23 is an end view of the dumbbell of FIG. 22, shown relative to an underlying base.
FIG. 24 is a front view of the dumbbell of FIG. 22, shown in a first selective configuration.
FIG. 25 is an end view of the dumbbell of FIG. 22, shown in a second selective configuration and relative to the underlying base first shown in FIG. 23.

A peg 439 projects from an opposite end of the tube 432 and parallel to the latch 430. As shown in FIG. 23, the peg 439 inserts into a first, radially inward hole in the plate 411 to secure or lock the latch 430 in the closed position. As shown in FIG. 25, the peg 439 inserts into a second, radially outward hole in the plate 411 to secure or lock the latch 430 in the open position. Movement of the tube 432 against the force of the spring 438 and toward the member 436 unlocks the latch 430 and allows it to be moved between the open position and the closed position. In other words, the latch 430 moves in a first, radial direction Y between a closed position and an open position, and the tube 432 moves in a second, axial direction X to lock and unlock the latch 430.

Each of the weights 440*a*–440*h* includes identical first and second plates 444, and a respective connector rod 446*a*–446*h* rigidly interconnected therebetween. Each plate 444 may be described as disc-shaped and includes a first, relatively large notch 442 to receive and accommodate the handle bar 420, and a second, generally L-shaped notch 443 which coincides in size and shape with a portion of the slots 413 in the plates 411.

The rod 446*a* is relatively short, and the weight 440*a* is disposed between the plates 444 on the other weights 440*b*–440*h*. The rod 446*h* is relatively long, and the plates 444 on the weight 440*h* are disposed outside the other weights 440*a*–440*g*. The rods 446*b*–446*g* and the plates 444 on the weights 440*b*–440*g* fall in between these two extremes.

The weights 440*a*–440*h* are supported by a base 490 when not carried away on the handle assembly 410. The base 490 has a flat bottom surface 492 and an arcuate top surface 494. The top surface 494 coincides with the lower periphery of the plates 411 and 444 and supports same in cup-like fashion. The base 490 has opposing side walls or surfaces 496 and 498 which extend in convergent fashion from opposite edges of the bottom surface 492 to opposite edges of the top surface 494. The side walls 496 and 498 cooperate with the rods 446*h* and 418, respectively, to maintain the weights 440*a*–440*h* and the handle assembly 410 in relative alignment. In particular, when the rods 446*h* and 418 abut respective side walls 496 and 498, the slots 413 in the plates 411 are disposed within the confines of the notches 442 in the plates 444 on the weight 440*h*. The same is true for each of the other weights 440*a*–440*g* having a respective rod 446*a*–446*g* rotated as far as possible toward the side wall 496.

A peg or stop 416 is provided on each of the plates 411 to facilitate alignment of the notches 443 relative to the slots 413. The pegs 416 project toward one another from respective plates 411 at a radial distance from the bar 420 equal to the radial distance between the rods 440*a*–440*h* and the bar 420. As a result, the rod 446*a* encounters the pegs 416 as the weight 440*a* is rotated relative to the handle assembly 410 and away from the surface 496 on the base 490. When the rod 446*a* abuts the pegs 416, the notches 443 in the plates 444 on the weight 440*a* align with the slots 413 in the plates 411, thereby allowing the latch 430 to occupy the radially inward ends of the notches 443, as well as the radially inward ends of the slots 413.

The present invention may also be described in terms of various methods. To illustrate this point, operation of the foregoing dumbbell 400 will be described with reference to methods of providing adjustable resistance to exercise. One such method may be described in terms of the steps of providing a base 490 sized and configured to support a plurality of weights 440*a*–440*h* in either of two positions; providing a handle assembly 410 with a handle bar 420 and a movable latch 430; selectively moving a desired number of the weights 440*a*–440*b* to an "engageable" position relative to the base 490; and moving the latch 430 into engagement with the weights 440*a*–440*h* occupying the "engageable" position. A further step may involve providing a biasing force and/or a structural interconnection which encourages the latch 430 and the weights 440*a*–440*h* to remain interengaged.

Figure 26:
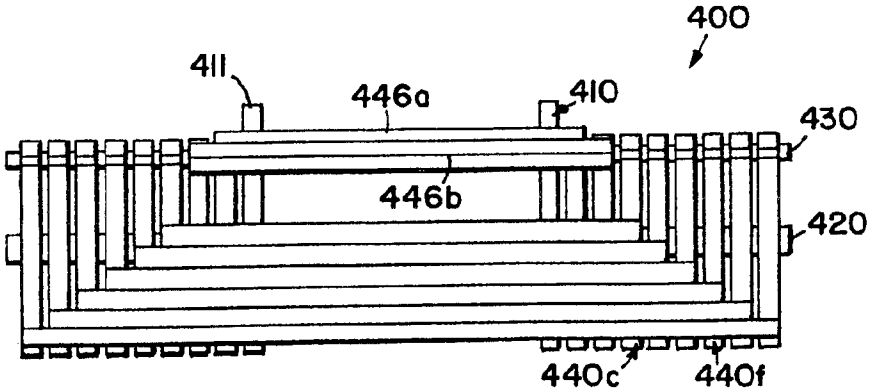
FIG. 26 is a front view of the dumbbell of FIG. 25.
Figure 27:
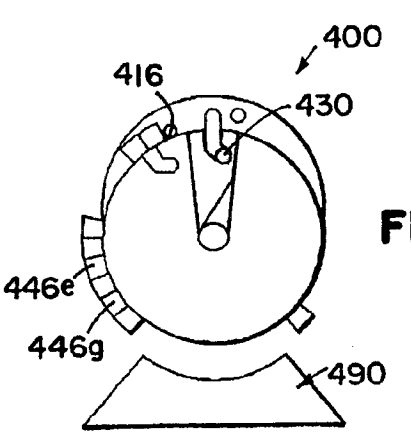
FIG. 27 is an end view of the dumbbell of FIG. 22, shown in a third selective configuration and relative to the underlying base first shown in FIG. 23.
Figure 28:
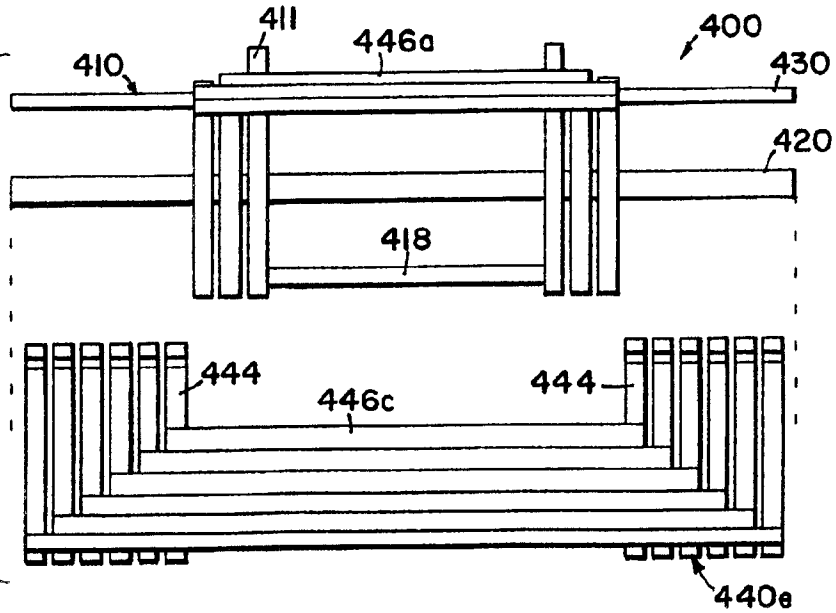
FIG. 28 is a front view of the dumbbell of FIG. 22, shown in an operative configuration with two discretionary weights connected to the handle assembly.
Figure 29:
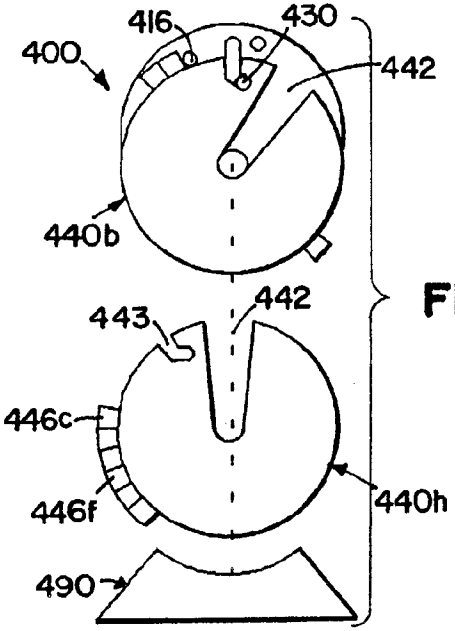
FIG. 29 is an end view of the dumbbell of FIG. 28, shown relative to the underlying base first shown in FIG. 23.

Various stages of the foregoing method are shown in the Figures. For example, in FIGS. 22–23, the latch 430 occupies the closed position relative to the plates 411 and is locked in that position by the peg 439. In FIG. 24, the latch 430 is locked in the open position, and the weights 440*a*–440*h* are free to rotate relative to the handle assembly 410 and/or the base 490. In FIGS. 25–26, the first two weights 440*a*–440*b* are shown rotated toward the pegs 416 until their notches 443 align with the slots 413. In FIG. 27, the latch 430 again occupies the closed position and is locked in that position by the peg 439. In FIGS. 28–29, the handle assembly 410 and weights 440*a*–440*b* are moved away from the base 490 and the remaining "unselected" weights 440*c*–440*h*.

With reference to the dumbbell 400, further method steps may include, for example, maintaining each of the plates 444 a fixed distance from the handle assembly 410 and/or adjacent plates 411 and 444. In this regard, spacers may be provided on the handle assembly 410 and/or on the plates 444 themselves. Methods and/or method steps may also be described with reference to more than one of the embodiments described above. For example, the present invention discloses a method of providing adjustable resistance to exercise involving the steps of disposing weights on opposite sides of a handle; supporting a desired number of weights against movement in a first direction relative to the handle; and applying a biasing force in a second, orthogonal direction to maintain the support for the weights. Those skilled in the art will also recognize other, non-disclosed structures which may be used to implement any of the methods described above or suggested by the foregoing embodiments. For example, a detent arrangement may be used to perform the "maintaining" step.

Yet another possible variation of the present invention is to arrange a plurality of loose weight plates in a row; move the desired number of plates upward relative to the remainder so that holes through the displaced plates align with holes in plates on a handle assembly; and insert a rod through the aligned holes to connect the displaced plates to the handle assembly. Still another possible variation is to use clips to connect multiple weight plates or weight housings to build weight combinations or modules which, in turn, may be selectively connected to a handle assembly or within compartments on a handle assembly.

Recognizing that aspects of various methods and/or embodiments of the present invention may be mixed and matched in numerous ways to arrive at still more variations of the present invention, and that this disclosure is likely to lead those skilled in the art to derive additional variations, the scope of the present invention is to be limited only to the extent of the following claims.

What is claimed is:

1. A method of facilitating weight adjustment on an exercise dumbbell, comprising the steps of:

providing a handle assembly having a first plate, a second plate, a handle interconnected between the first plate and the second plate, a first bar projecting outward from the first plate in a first direction away from the handle, and a second bar projecting outward from the second plate in a second, opposite direction away from the handle;

providing a first weight that is configured to be secured in place between the first plate and a distal end of the first bar with the first bar occupying a downwardly opening slot in the first weight;

providing a second weight that is configured to be secured in place between the second plate and a distal end of the second bar with the second bar occupying a downwardly opening slot in the second weight;

providing a base having an upwardly facing support surface configured to support the handle assembly in a desired handle orientation with each said plate having a lower edge resting in a stable orientation on the support surface, and having a discrete portion configured to support each said weight independent of the handle assembly and in a desired weight orientation with each said slot opening downward; and requiring each said weight to be lifted upward from the bass for movement between the handle assembly and the discrete portion of the base.

2. The method of claim 1, further comprising the steps of:

lifting the first weight upward from the discrete portion of the base, and holding the first weight so that the slot in the first weight opens downward toward the first bar;

sliding the first weight downward onto an exposed and uninterrupted section of the first bar that is long enough to accommodate both the first weight and another said first weight, and releasably securing the first weight against movement relative to the handle assembly with the first bar occupying the slot in the first weight;

lifting the second weight upward from the discrete portion of the base, and holding the second weight so that the slot in the second weight opens downward toward the second bar; and sliding the second weight downward onto an exposed and uninterrupted section of the second bar that is long enough to accommodate both the second weight and another said second weight, and releasably securing the second weight against movement relative to the handle assembly with the second bar occupying the slot in the second weight, wherein the handle assembly and each said weight define a loaded handle assembly.

3. The method of claim 2, wherein the handle assembly is provided with a first fastener on a distal end of the first bar to limit movement of the first weight in a direction parallel to a longitudinal axis defined by the first bar, and with a second fastener on a distal end of the second bar to limit movement of the second weight in a direction parallel to a longitudinal axis defined by the second bar.

4. The method of claim 3, wherein the handle assembly is provided with each said fastener rigidly secured to a respective said bar, and at least one weight receiving space is defined between the first fastener and the first plate, and at least one weight receiving space is defined between the second fastener and the second plate.

5. The method of claim 4, wherein the handle assembly is provided with each said bar rigidly secured to the handle, thereby defining a fixed length for each said weight receiving space.

6. The method of claim 2, further comprising the steps of providing an additional first weight with a downwardly opening slot configured to receive the first bars lifting the additional first weight and holding the additional first weight so that the slot in the additional first weight opens downward toward the first bars; and sliding the third additional first weight downward about onto the exposed and uninterrupted section of the first bar in such a manner that each said first weight bears against the other said first weight to maintain its position along the first bar, and releasably securing the additional first weight against movement relative to the handle assembly with the first bar occupying the slot in the third additional first weight.

7. The method of claim 6, wherein the first weight and the additional first weight are releasably secured to the handle assembly without any intervening structure disposed between any portion of the first weight and any portion of the additional first weight.

8. The method of claim 1, wherein the handle assembly is provided with each said bar axially aligned with the handle and integrally connected to the handle.

9. The method of claim 1, wherein the discrete portion of the base is configured to support more than one said weight without any intervening structure disposed therebetween, and without requiring any one said weight to be lifted prior to another said weight.

10. The method of claim 9, wherein the handle assembly is configured to support more than one said weight in a respective uninterrupted space along each said bar, and further comprising the steps of lifting one said first weight and another said first weight upward from the base; and securing each said first weight on the first bar in respective positions bearing against each other to remain in said respective positions.

11. The method of claim 1, wherein the handle assembly is provided with a first fastener on a distal end of the first bar at a distance from the first plate suitable for holding three five pound weights therebetween, and with a second fastener on a distal end of the second bar at a distance from the second plate suitable for holding three five pound weights therebetween.

12. The method of claim 1, wherein each said weight is selectively mounted on the handle assembly in a perpendicular orientation relative to the first direction and the second direction with each said slot opening downward, and each said weight occupies a perpendicular orientation relative to the first direction and the second direction with each said slot opening downward when the handle assembly is resting on the support surface.

13. The method of claim 12, further comprising the step of providing a second said handle assembly, wherein the base is provided with a second upwardly facing support surface configured to support the second handle assembly and for each said handle assembly, moving at least one said weight from the discrete portion to a respective said handle assembly in a direction perpendicular to the first direction and the second direction.

14. The method of claim 1, wherein the base is configured to maintain each said weight on the handle assembly in a common orientation with each said weight on the discrete portion of the base, so any said weight is movable between a position on the of the base without requiring a change in orientation of the any said weight.

15. The method of claim 1, wherein the base is configured to hold each said weight on the handle assembly in co-planar relationship to with each said weight on the discrete portion of the base, so any said weight is movable between a position on the handle assembly and an alternative position on the discrete portion of the base without altering the co-planar relationship.

16. The method of claim 1, further comprising the steps of:

lifting the first weight upward from the bases;

sliding the first weight downward onto the first bar; and securing the first weight in place on the first bar, wherein the lifting, sliding, and securing steps are performed in succession without requiring any change in orientation of the first weight.

17. The method of claim 16, wherein each said plate is provided with a respective said lower edge defining a flat bottom surface, and further comprising the steps of:

removing all said weight from the handle assembly; and resting the handle assembly on the base with each said flat bottom surface resting on the upwardly facing support surface.

18. The method of claim 16, wherein each said weight is provided with a flat bottom surface, and further comprising the steps of:

securing the first weight and the second weight to the handle assembly; and resting the handle assembly on the base with each said flat bottom surface resting on the upwardly facing support surface.

19. The method of claim 1, wherein each said plate is provided with a respective said lower edge defining a flat bottom surface, and further comprising the steps of:

removing all said weight from the handle assembly; and resting the handle assembly on the base with each said flat bottom surface resting on the upwardly facing support surface.

20. The method of claim 1, wherein each said weight is provided with a flat bottom surface, and further comprising the steps of:

securing the first weight and the second weight to the handle assembly; and resting the handle assembly on the base with each said flat bottom surface resting on the upwardly facing support surface.

* * * * *